US005855714A

United States Patent [19]

Bockh

[11] Patent Number: 5,855,714

[45] Date of Patent: Jan. 5, 1999

[54] ROLL SPLICING SYSTEM AND METHOD

[76] Inventor: Mat G. Bockh, 170 Belknap Point Rd., Gilford, N.H. 03246

[21] Appl. No.: 707,881

[22] Filed: Sep. 9, 1996

[51] Int. Cl.[6] ..... B65H 69/06

[52] U.S. Cl. ..... 156/157; 156/502; 156/504; 156/505; 242/164; 242/173; 242/532.3; 242/555.4; 242/556.1

[58] Field of Search ..... 156/157, 502, 156/504, 505; 242/551, 555, 555.4, 555.5, 555.6, 556.1, 532.3, 164, 173

[56] References Cited

U.S. PATENT DOCUMENTS

| | | | |
|---|---|---|---|
| 2,320,656 | 6/1943 | Roesen | 156/157 X |
| 2,386,344 | 10/1945 | Roesen | 242/556.1 X |
| 3,554,829 | 1/1971 | Luckett, Sr. | 156/157 |
| 3,863,855 | 2/1975 | Gaubert | 242/58.4 |
| 3,895,763 | 7/1975 | Tokuno | 242/58.3 |
| 3,920,502 | 11/1975 | Tokuno | 156/504 |
| 3,989,576 | 11/1976 | Collin et al. | 156/361 |
| 4,010,061 | 3/1977 | Tokuno | 156/504 |
| 4,080,231 | 3/1978 | Tokuno | 156/157 |
| 4,106,974 | 8/1978 | Hirsch | 156/504 |
| 4,172,755 | 10/1979 | Gustafson et al. | 156/504 |
| 4,177,959 | 12/1979 | Lancaster et al. | 242/58.2 |
| 4,238,261 | 12/1980 | Tetro | 156/157 |
| 4,290,834 | 9/1981 | Buettel | 156/157 |
| 4,555,070 | 11/1985 | Pali | 242/58.1 |
| 4,564,413 | 1/1986 | Murakami | 156/504 |
| 5,105,944 | 4/1992 | Ingalls et al. | 242/532.3 X |
| 5,275,344 | 1/1994 | Ray | 242/58.5 |
| 5,280,862 | 1/1994 | Oya et al. | 242/532.3 X |
| 5,335,870 | 8/1994 | Martin | 242/555.4 |
| 5,397,076 | 3/1995 | Padilla | 242/556.1 |

FOREIGN PATENT DOCUMENTS

| | | | |
|---|---|---|---|
| 62-295854 | 12/1987 | Japan | 242/532.3 |
| 4-368686 | 12/1992 | Japan | 242/532.3 |

*Primary Examiner*—Mark A. Osele
*Attorney, Agent, or Firm*—Bourque & Associates P.A.

[57] ABSTRACT

A roll splicing system and method is used to splice a new roll to an expiring roll of material. Each roll includes an adhesive region disposed proximate a trailing end of the strip of material rolled around a core region of the roll. As an expiring roll expires or unrolls, the adhesive region is exposed and adheres to an adhesive adherable region on the leading end of a new roll that is rotating against the expiring roll in an opposing direction. The leading end of the new roll is thereby effectively spliced to the trailing end of the expiring roll. A trailing non-adherable region is disposed opposite the adhesive region so that the trailing non-adherable region contacts the adhesive region when rolled and prevents the strip of material from sticking to the adhesive region. The roll splicing system and method can be used to splice strips of material having adherable surfaces on both sides or having a non-adherable surface, such as a silicone coating, on one side of the strip of material.

27 Claims, 7 Drawing Sheets

ROLL SPLICING SYSTEM AND METHOD

FIELD OF THE INVENTION

The present invention relates to a system and method for splicing rolls of material and in particular, to a roll splicing system and method that splices the leading end of a new roll to an adhesive region disposed at the trailing end of an expiring roll.

BACKGROUND OF THE INVENTION

In manufacturing processes where a rolled product is applied, splicing of a strip or sheet of material from an expiring or unwinding roll to a new strip of material is often required for the process to run smoothly and efficiently. The manufacturing of shingles or other roofing products, for example, involves unrolling a roll of tape material and continuously applying the tape to a moving web. Conventional systems for splicing a new roll to an expiring roll include complex and expensive automatic splicing machinery. Other methods call for slowing down or stopping the web to allow an operator to start the new roll of tape or material when the old one runs out. A further method includes having an operator Start the new roll on the fly, without slowing down the web.

Numerous disadvantages exist in the existing roll splicing systems and methods used to splice tapes in the roofing industry and to splice other types of materials in other manufacturing processes. The complex and expensive splicing machinery often used in many conventional splicing systems includes a large number of moving parts, requiring continuing maintenance and a significant amount of space. Extensive operator intervention is also required to operate such machinery and make sure that the rolls of material are effectively spliced. Improper maintenance or operation of such complex splicing machinery often results in missed splices, causing wasted time and materials. If the spliced material is being used to cover another type of material in a production process, the entire process may have to be shut down to prevent damage to the production machinery and waste of the production materials.

The existing manual splicing systems and methods require more extensive operator intervention. Manual splicing systems and methods that require the whole process to be slowed or stopped completely to effect the splicing of the rolls also significantly slow the manufacturing process. Manual splicing systems in which an operator starts a new roll on the fly can slow the production process and waste material when splices are missed as a result of operator error. Moreover, such extensive reliance on manual operation often results in unnecessary injuries to the operators. In addition, existing splicing systems do not adequately splice materials or products having non-stick or non-adherable surfaces, such as silicone coated surfaces.

Accordingly, what is needed is a roll splicing system and method in which a splice is effected between a new roll of material and an expiring roll of material in a reliable and cost efficient manner regardless of whether the materials include a non-adherable surface. The roll splicing system and method according to the present invention does not require complex and expensive automatic splicing machinery. The roll splicing system and method according to the present invention also requires minimal operator intervention and does not require the rolls or the production process to be stopped or significantly slowed in order to effect the splice.

SUMMARY OF THE INVENTION

The present invention features a system and method of splicing a new roll of material to an expiring roll of material.

The roll splicing system comprises at least one roll including a core region and a strip of material wound around the core region. The strip of material has a trailing end disposed proximate the core region and a leading end disposed proximate an outer roll surface of the roll. At least one adhesive adherable region is disposed proximate the leading end of the strip of material. An adhesive region is disposed proximate the trailing end of the strip of material, for adhering to the adhesive adherable region of a new roll when the roll expires, thereby splicing the new roll to the expiring roll. A trailing non-adherable region is disposed proximate the trailing end of the strip of material opposite the adhesive region and extends beyond the adhesive region for at least one turn of the roll so that the adhesive region is contacted by the trailing non-adherable region when rolled around the core region.

The roll preferably includes a first adhesive adherable region disposed at the leading end of the strip of material, a leading non-adherable region adjacent the first adhesive adherable region, and a second adhesive adherable region adjacent the leading non-adherable region. The leading non-adherable region extends for at least one turn of the roll such that the adhesive region of an expiring roll will initially adhere to the first adhesive adherable region of a new roll, not the leading non-adherable region, to start the new roll unwinding. The adhesive region has a length of at least one turn of the new roll and preferably about two turns such that about one turn of the second adhesive adherable region will adhere to the adhesive region.

According to one embodiment, the adhesive region, the trailing non-adherable region, the first adhesive adherable region, the leading non-adherable region, and the second adhesive adherable region are disposed directly on the strip of material. For example, the adhesive region is disposed on an outer surface of the strip of material proximate the trailing end, and the trailing non-adherable region is disposed on an inner surface of the strip of material proximate the trailing end.

According to other embodiments, the adhesive region, the trailing non-adherable region, the first adhesive adherable region, the leading non-adherable region, and the second adhesive adherable region are disposed on one or more trailing segments and leading segments. One embodiment of the roll includes a trailing segment having a first trailing segment end releasably coupled to the core region and a second trailing segment end coupled to the trailing end of the strip of material. The trailing segment has the adhesive region on an outer surface of the trailing segment and the trailing non-adherable region on an inner surface of the trailing segment. The trailing non-adherable region contacts the adhesive region when the trailing segment is wound around the core region such that an inner surface of the strip of material does not contact the adhesive region of the trailing segment when the strip of material is wound around the core region.

According to one embodiment, at least one turn of the strip of material is adhered to a first portion of the adhesive region of the trailing segment proximate the second trailing segment end. The adhesive region also includes a second portion having a length of at least one turn of the new roll, for adhering to the at least one adhesive adherable region on a new strip of material proximate the leading end of the new roll. Alternatively, the second trailing segment end of the trailing segment is coupled to the trailing end of the strip of material using an adhesive tape.

A further embodiment of the roll includes at least first and second leading segments coupled proximate the leading end of the strip of material. The first leading segment includes the first adhesive adherable region, and the second leading segment coupled to the first leading segment includes the leading non-adherable region. A further embodiment includes a third leading segment coupled to the second leading segment and having the second adhesive adherable region. The second leading segment preferably has a length of at least one turn of the roll, and the first leading segment is preferably releasably coupled to the outer roll surface of the roll such that the adhesive region of an expiring roll will initially adhere to the first leading segment and begin unwinding of the roll.

Examples of the rolls include rolls having a strip of material with outer and inner surfaces of an adhering material and rolls having a strip of material with at least one surface of a non-adhering material. One example of a non-adherable region or surface includes a silicone coating. One example of the adhesive region includes an adhesive, such as hot melt adhesives.

One embodiment of the roll splicing system includes a first roll having a strip of material with an outer non-adherable surface and a second roll with a strip of material having an inner non-adherable surface. The first roll splices with the second roll such that the outer non-adherably surface of the first roll is oriented in the same direction as the inner non-adherable surface of the second roll.

The roll splicing system preferably includes first and second spindles. A first roll is disposed on the first spindle and a second roll is disposed on the second spindle. In one embodiment, the first spindle is fixed and the second spindle is pivotable. One of the first and second rolls is an expiring roll rotating in a first direction and the other of the first and second rolls is a new roll rotating in a second direction opposite the first direction, for splicing with the expiring roll at the adhesive region proximate the trailing end of the expiring strip of material.

The method of splicing a new roll to an expiring roll comprises the steps of: unrolling the expiring roll; rotating the new roll proximate the expiring roll; contacting a portion of the new strip of material proximate the leading end of the new strip of material of the new roll with an adhesive region proximate a trailing end of the expiring strip of material of the expiring roll such that the portion of the new strip of material adheres to the adhesive region; and unrolling the new roll. The preferred method includes removing the expiring roll from the first spindle when the expiring roll has expired; and rotatably mounting a new roll on the first spindle.

DESCRIPTION OF THE DRAWINGS

These and other features and advantages of the present invention will be better understood by reading the following detailed description, taken together with the drawings wherein.

DETAILED DESCRIPTION OF THE PREFERRED EMBODIMENT

A roll splicing system and method 10, FIGS. 1A–1D, according to the present invention, is used to automatically splice a first or expiring roll of product or material 12*a* to a second or new roll of product or material 12*b*. The expiring roll of material 12*a* and new roll of material rotate against one another in opposite directions as indicated by arrows 4, 6 until the expiring roll 12*a* expires or unwinds and a new strip of product or material 14*b* is spliced to the expiring strip of product or material 14*a*, as will be described in greater detail below.

One application of the roll splicing system and method 10 is in the production of shingles or roofing products in which rolls of tape are spliced and continuously applied to a moving web. The tape typically has a non-adherable surface, such as silicone coated release paper or film on one side, and the web is typically a roofing membrane or substrate, such as an asphalt, impregnated mat or felt used in the roofing industry. The present invention also contemplates using the roll splicing system and method 10 to splice rolls of any type of material in any type of application including, but not limited to, other roofing applications, printing, laminating, applying sealing tape to envelopes or containers, bag making, printed label application, and tape dispensing.

The roll splicing system and method 10 can be used to splice a roll of any size or type of material having adherable surfaces or at least one non-adherable surface, such as a silicone coating. Different embodiments of the rolls are used depending upon whether the strip of material has the same type of surface on each side or different types of surfaces on each side. For example, where both inner surfaces 13*a*, 13*b* and outer surfaces 15*a*, 15*b* of the material 14*a*, 14*b* are adherable, the new and expiring rolls 12*a*, 12*b* being spliced can be of the same type.

Where one of the surfaces is adherable and the other is non-adherable, the new and expiring rolls 12*a*, 12*b* being spliced together are of different types so that like surfaces of the materials are oriented in the same direction when the rolls are rotated in opposite directions during splicing. For example, one of the rolls 12*a* has the product or material 14*a* rolled so that an inner surface 13*a* is adherable and an outer surface 15*a* is non-adherable and the other of the rolls 12*b* has the product or material 14*b* rolled so that the inner surface 13*b* is non-adherable and the outer surface 15*b* is adherable. When spliced, the adherable inner surface 13*a* and adherable outer surface 15*b* are oriented to face in the same direction and the non-adherable outer surface 15*a* and non-adherable inner surface 13*b* are oriented to face in the same direction (see FIG. 1B).

Figure 1A:
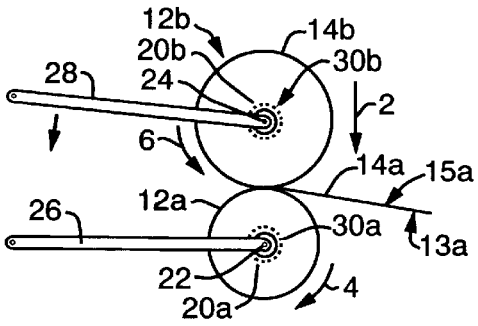
FIGS. 1A–1D are side schematic views of the roll splicing system and method according to the present invention.

Each of the rolls 12*a*, 12*b*, FIG. 1A, includes a continuous strip of material 14*a*, 14*b* wound around a core region 20*a*,

20*b*. The expiring strip of material 14*a* from the expiring roll 12*a* is unwound or unrolled in the direction of arrow 4 to be applied in a production process, for example, to be pulled along by and applied to a moving web. Each of the rolls 12*a*, 12*b* also includes an adhesive region 30*a*, 30*b* disposed generally at the core region 20*a*, 20*b* of the respective roll to effect a splice between the expiring strip of material 14*a* and the new strip of material 14*b* when the expiring strip of material 14*a* is unwound to expose the adhesive region 30*a*, as will be described in greater detail below.

The expiring roll 12*a* and tie new roll 12*b* are each mounted on first and second spindles 22, 24, respectively, for rotation in opposing directions as indicated by arrows 4, 6. One or more of the spindles 22, 24 are moveable with respect to each other, for example, to move the new roll 12*b* toward and into contact with the expiring roll 12*a*, as indicated generally by arrow 2, as the expiring roll 12*a* is unrolled. In one example, the spindles 22, 24 are mounted on support members 26, 28. At least one of the support members 28 pivots to move an expiring roll toward and against a new roll to effect a splice and or to move an expired roll to allow the expiring roll to be replaced with a new roll.

Figure 1B:
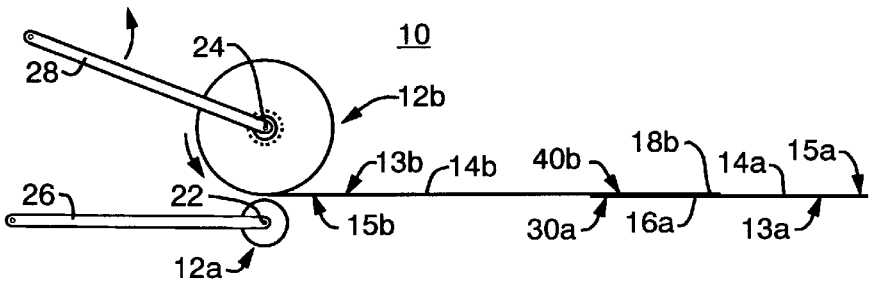

When the expiring roll 12*a*, FIG. 1B, has expired or unwound, the adhesive region 30*a* proximate the trailing end 16*a* of the expiring strip of material 14*a* from the expiring roll 12*a* adheres to at least a first adhesive adherable region 40*b* on the new strip of material 14*b* proximate the leading end 18*b* of the new strip of material 14*b*. The second or new roll 12*b* now becomes an expiring roll and is unwound or unrolled. The moving spindles 22, 24 allow the expiring roll 12*a* to be replaced with a new roll.

Figure 1C:
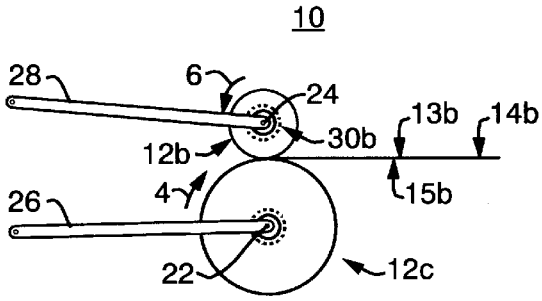
Figure 1D:
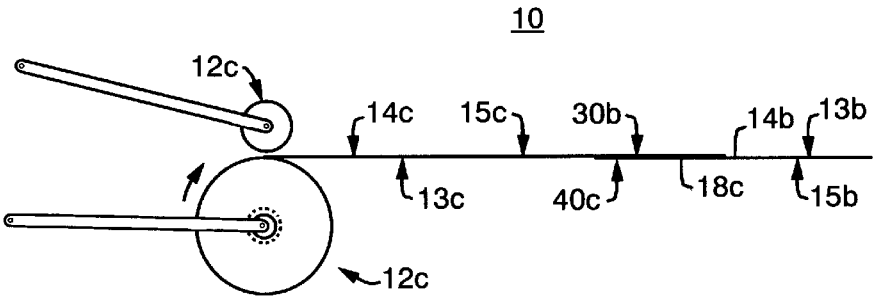

A further new roll 12*c*, FIG. 1C, is then mounted onto the spindle 22 to effect a splice with the now expiring roll 12*b*. Both the new roll 12*c* and expiring roll 12*b* are rotating in opposite directions as indicated by arrows 4, 6. When the adhesive region 30*b*, FIG. 1D, of the expiring roll 12*b* is exposed, the adhesive region contacts the first adhesive adherable region 40*c* proximate leading end 18*c* of the new roll 12*c* and splices the expiring strip of material 14*b* to the new strip of material 14*c*. The spindles 22, 24 may then be moved apart to allow the expiring roll 12*b* to be replaced with a further new roll. This process then repeats and may be continued for as long as desired.

Figure 2:
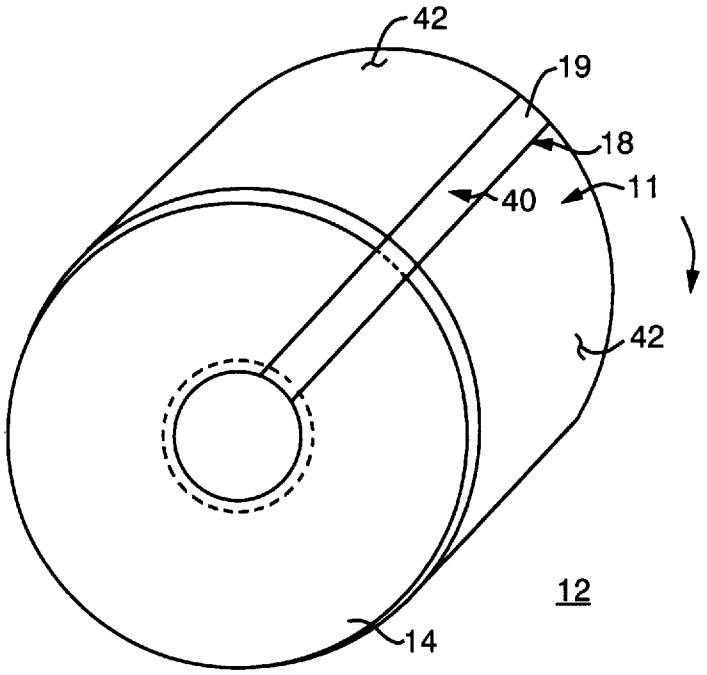
FIG. 2 is a side perspective view of a roll according to the present invention.

The leading end 18, FIG. 2, of each new roll 12 is releasably coupled to the outer surface 11 of the new roll 12, for example, with a piece of adhesive tape 19 or other similar coupling member. The new roll 12 can then rotate prior to splicing with an expiring roll without having the strip of material 14 prematurely unrolling or unraveling. One example of tape 19 has a width of about 1 in. and a length that extends across the leading end 18 of the strip of material 14 and around each side of the roll 12. The roll 12 also preferably includes a leading non-adherable region 42 on a substantial portion of the roll outer surface 11 such that the adhesive region 30 will initially adhere only at the first adhesive adherable region 40 proximate the leading end 18. In one example, the tape 19 includes at least part of the first adhesive adherable region 40 such that the tape 19 will release when adhered to the adhesive region 30 of an expiring roll and the roll 12 begins to unwind.

Figure 3:
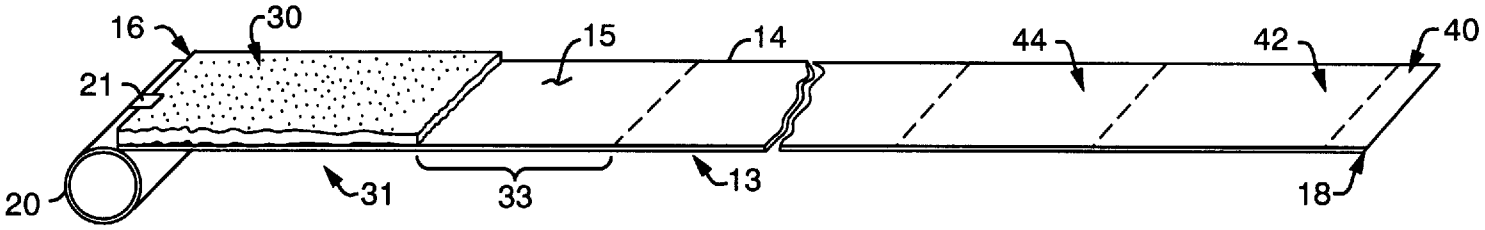
FIG. 3 is a perspective view of an unwound roll according to the present invention.

The adhesive region 30, FIG. 3, is disposed proximate the trailing end 16 of the strip of material 14 and preferably has a length of at least one turn of a new roll such that the adhesive region 30 will adhere to the first adhesive adherable region 40 on a new roll. The adhesive on the adhesive region 30 includes, but is not limited to, a hot melt adhesive or other suitable adhesives. A trailing non-adherable region 31, such as a silicone coating or other non-adherable surface, is disposed proximate the trailing end 16 and opposite the adhesive region 30. A portion 33 of the trailing non-adherable region 31 preferably extends beyond the adhesive region 30 for at least one turn of the roll so that the trailing non-adherable region 31 will contact the entire length of the adhesive region 30 when rolled around the core region 20. If an inner surface 13 of the strip of material 14 is adherable, the inner surface 13 will be prevented from contacting and sticking to the adhesive region 30 when rolled about the core region 20.

The first adhesive adherable region 40 is disposed proximate the leading end 18 and the leading non-adherable region 42 is disposed proximate the first adhesive adherable region 40. A second adhesive adherable region 44 is preferably disposed proximate the leading non-adherable region 42. The adhesive region 30 of an expiring roll will therefore initially adhere to the first adhesive adherable region 40 and then adhere to the second adhesive adherable region 44 after the leading non-adherable region 42 has unwound. The second adhesive adherable region 44 preferably has a length of at least one turn of the roll, for adhering to at least one turn of the adhesive portion 30 of an expiring strip of material.

According to one embodiment, the adhesive region 30, the trailing non-adherable region 31, the first adhesive adherable region 40, the leading non-adherable region 42, and the second adhesive adherable region 44 are disposed directly on the strip of material 14, as shown in FIG. 3. By treating the strip of material 14 with the adhesive, adhesive adherable, or non-adherable surfaces, this embodiment can be used where both of the inner and outer surfaces 13, 15 of the strip of material 14 are adherable and also where one of the inner and outer surfaces 13, 15 is adherable and the other is non-adherable. As described above, where one of the surfaces 13, 15 is adherable and the other is non-adherable, two types of rolls according to this embodiment are used as the new and expiring rolls so that like surfaces are oriented in the same direction.

Other embodiments of the present invention include one or more leading segments and trailing segments. One embodiment includes a trailing segment 32, FIG. 4, having a first trailing segment end 35 releasably coupled to the core region 20 and a second trailing segment end 37 coupled to the strip of material 14 proximate the trailing end 16 of the strip of material 14. The trailing segment 32 includes the adhesive region 30 disposed on an outer surface 34 of the trailing segment 32. The trailing non-adherable region 31, such as a silicone coated surface, is disposed on an inner surface 36 of the trailing segment 32 and has a length so that the trailing segment 32 can be rolled onto the core region 30 without adhering to itself.

This embodiment of the roll is used to splice a strip of material 14 having both inner and outer surfaces 13, 15 of an adherable material, such as paper or other types of material that easily adhere to the adhesive on the adhesive region 30. The new and expiring rolls being spliced together can be identical rolls of this type since both surfaces of the strip of material are the same.

To couple the trailing segment 32 to the strip of material 14, the inner adherable surface 13 of at least one turn of the strip of material 14 is preferably adhered to a first portion 38 of the adhesive region 30 on the trailing segment 32. The strip of material 14 overlaps the first portion 38 of the adhesive region 30 by at least one turn to prevent the inner adherable surface 13 of the strip of material 14 from contacting and sticking to the adhesive region 30 of the leading segment 32. When rolled about the core region 20, the inner non-adherable surface 36 will contact the adhesive region 30 and the beginning 17 of the inner adherable surface 13 of the strip of material 14 will roll against the outer adherable surface 15 of the strip of material 14 but not the adhesive region 30, so that the leading segment 32 can be unrolled without sticking together.

A second portion 39 of the adhesive region 30 has a length equivalent to at least one turn (i.e. the outer diameter) of a new roll so that at least the first adhesive adherable region 40 of the new roll will adhere to the adhesive region 30 of the leading segment 32. The second portion 39 of the adhesive region 30 preferably has a length of at least two turns of the new roll such that at least one turn of the second adhesive adherable region 44 will adhere to the second portion 39 of the adhesive region 30, thereby securely splicing the strip of material 14 of an expiring roll to a strip of material of a new roll. The trailing segment 32 can be releasably coupled to the core region 20 with an adhesive tape 21 or other similar coupling member.

In this embodiment, the leading non-adherable region 42 is disposed on a leading non-adherable segment 46 coupled to the strip of material 14, for example, with a piece of adhesive tape 41, double-sided tape, or other similar coupling member. The adhesive tape 19 for preventing the roll from unwinding is coupled to the leading non-adherable segment 46, for example, with another piece of adhesive tape 48 coupled to an adherable portion of the leading non-adherable segment 46. One example of the tape 48 has a width of about 2 in. and a length corresponding to the length of the roll. The first adhesive adherable portion 40 is formed on the tape 19, on the tape 48, or both. The second adhesive adherable portion 44, in this embodiment, is the outer adherable surface 15 of the product or strip of material 14.

Figure 4:
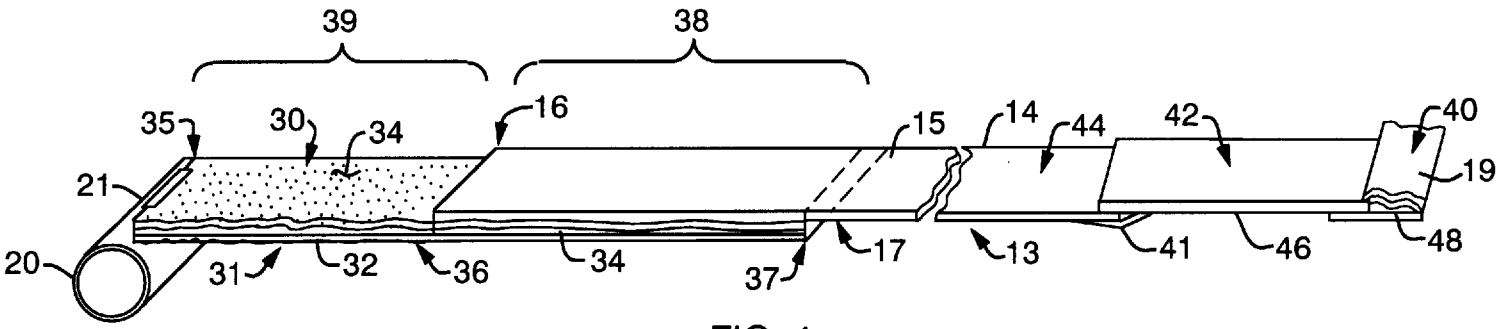
FIG. 4 is a perspective view of an unwound roll having trailing and leading segments coupled to a strip of material with both adherable surfaces, according to one embodiment the present invention.
Figure 5:
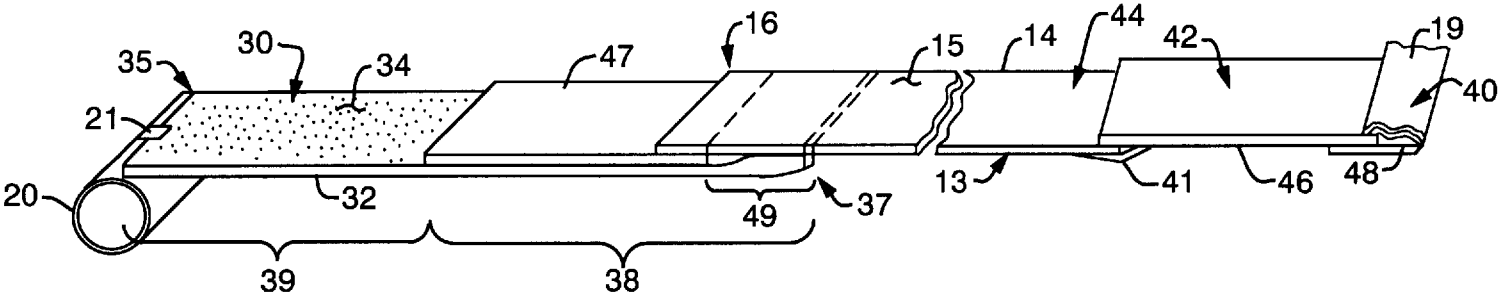
FIG. 5 is a perspective view of an unwound roll having trailing and leading segments coupled to a strip of material with both adherable surfaces, according to another embodiment of the present invention.

An alternative embodiment of the type of roll shown in FIG. 4 includes a separate layer of film 47, FIG. 5, which partly covers the second portion 38 of the adhesive region 30. The film 47 is made of an adherable material, such as polyester, polyethylene, polypropylene or other suitable materials that will adhere to the adhesive on the second adhesive portion 38. According to this embodiment, the end of the inner adherable surface 13 of the strip of material 14 will contact the film 47 when rolled on the core region 20, thereby preventing the inner adherable surface 13 from sticking to the adhesive of the outer adhesive region 30 of the leading segment 32. A third portion 49 of the adhesive region 30 is adhered to a portion (e.g. approximately three to six inches) of the strip of material 14 to couple the leading segment 32 to the strip of material 14, and the trailing end 16 of the strip of material 14 overlaps the film 47, for example, by approximately one-half an inch.

One embodiment of the roll splicing system and method used to splice strips of material having an adherable surface and a non-adherable surface is described below in greater detail. In this embodiment one of the new and expiring rolls is a type "A" roll 50*a*, FIG. 6, and the other of the new and expiring rolls is a type "B" roll 50*b*, FIG. 7. Since the splicing is effected by rotating the rolls opposite one another, the type "A" roll 50*a* has the non-adherable surface 52*a* as the outer surface and the type "B" roll 50*b* has the non-adherable surface 52*b* as the inner surface so that the non-adherable surfaces will be oriented to match and face in the same direction when the type "A" roll 50*a* is spliced to the type "B" roll 50*b*.

Figure 6:
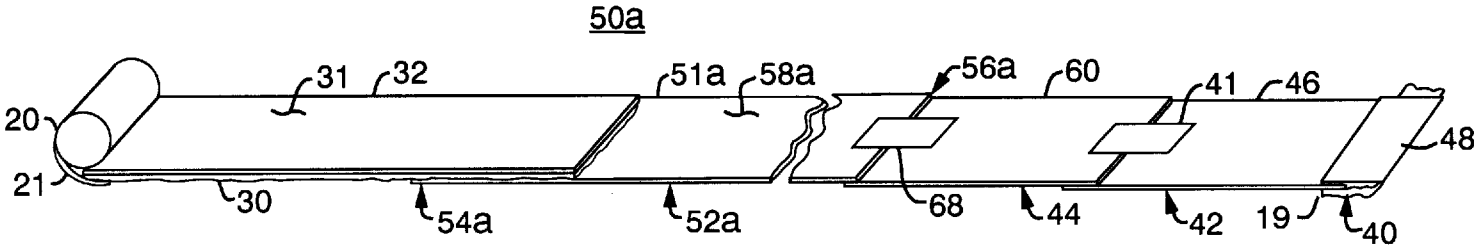
FIG. 6 is a perspective view of an unwound roll having trailing and leading segments coupled to a strip of material with adherable and non-adherable surfaces, according to a one embodiment of the present invention.

The type "A" roll 50*a*, FIG. 6, includes a trailing segment 32, as described above, coupled to the trailing end 54*a* of the type "A" roll 50*a* and releasably coupled to the core region 20, for example, with adhesive tape 21. Alternatively, the adhesive region 30 and trailing non-adherable region 31 can be disposed directly on the strip of material 51*a*, as described above.

The type "A" roll 50*a* further includes a leading adherable segment 60 coupled to a leading end 56*a* of the strip of material 51*a* from the type "A" roll 50*a*. The leading segment 60 includes the second adhesive adherable region 44, for adhering to the adhesive region 30 of a type "B" roll 50*b*, since the outer non-adherable surface 52*a* of the strip of material 51*a* will not adhere to the adhesive region 30. The leading segment 60 is coupled to the leading end 56*a* of the type "A" roll 50*a*, for example, using a piece of adhesive tape 68 between the leading segment 60 and the inner adherable surface 58*a* of the type "A" roll 50*a*. The leading segment 60 is preferably made of an adhesive adherable material, such as polyester, polyethylene, or polypropylene, that will adhere to the adhesive region. The leading adherable segment 60 preferably has a length of at least one turn of the type "A" roll 50*a* so that a length of at least one turn will adhere to the adhesive portion 30 of an expiring type "B" roll. Alternatively, the adhesive adherable region 40 can be disposed on the strip of material 51*a*, for example, by treating the non-adherable surface 52*a* or by not coating the non-adherable surface 52*a* with the non-adherable coating.

The type "A" roll according to this embodiment further includes a leading non-adherable segment 46 having the leading non-adherable region 42. An adherable portion of the leading non-adherable segment 46 is coupled to the leading adherable segment 60, for example, with a piece of adhesive tape 41, double-sided tape, or other similar coupling member. The adhesive tape 19 for preventing the roll from unwinding is coupled to the leading non-adherable segment 46, for example, with another piece of adhesive tape 48 coupled to an adherable portion of the leading non-adherable segment 46. The first adhesive adherable portion 40 is formed on the tape 19, on the tape 48, or both.

Alternatively, the second adhesive adherable region 44 and the leading non-adherable region 42 can be formed on a single leading segment, for example, by treating an adherable film with a non-adherable silicone coating.

Figure 7:
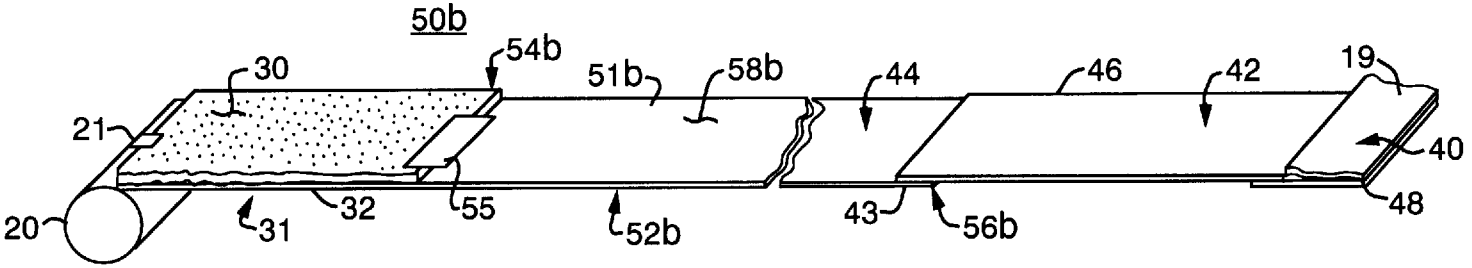
FIG. 7 is a perspective view of an unwound roll having trailing and leading segments coupled to a strip of material with adherable and non-adherable surfaces, according to another embodiment of the present invention.

The type "B" roll 50*b*, FIG. 7, includes a trailing segment 32 having the outer adhesive region 30 and inner trailing non-adherable region 31. In the type "B" roll, the non-adherable surface 52*b* will not adhere to the adhesive region 30 of the trailing segment. The trailing segment 32 in the type "B" roll 50*b* is coupled to the trailing end 54*b* of the strip of material 51*b* with a piece of adhesive tape 55 or other similar coupling member from the adherable surface 58*b* of the strip of material 51*b* from the type "B" roll 50*b* to the adhesive region 30 of the trailing segment 32. The trailing segment 32 can also be coupled to the trailing end 54*b* with stitching. Alternatively, the adhesive region 30 can be formed directly on the adherable surface 58*b* of the strip of material 51*b*.

The type "B" roll further includes a leading non-adherable segment 46 having the leading non-adherable region 42. The leading non-adherable segment 46 is coupled to the adherable surface 58*b* of the strip of material 51*b*, for example, with double-sided tape 43 or other similar coupling member. The adhesive tape 19 for preventing the roll from unwinding is coupled to the leading non-adherable segment 46, for example, with another piece of adhesive tape 48 coupled to an adherable portion of the leading non-adherable segment 46. The first adhesive adherable portion 40 is formed on the tape 19, on the tape 48, or both. The second adhesive adherable portion 44, in this embodiment, is the outer adherable surface 58*b* of the strip of material 51*b*.

Accordingly, the outer adhesive region 30 of the trailing segment 32 of the type "B" roll will initially adhere to the first adhesive adherable region 40 of the type "A" roll 50*a*, and the outer adhesive region 30 of the type "A" roll 50*a* will initially adhere to the first adhesive adherable region 40 of the type "B" roll 50*b* so that the non-adherable surfaces 52*a*, 52*b* have the same orientation. The type "A" and type "B" of rolls are alternated when replacing rolls in the roll splicing system so that a type "A" roll is spliced with a type "B", and vice versa.

Figure 8A:
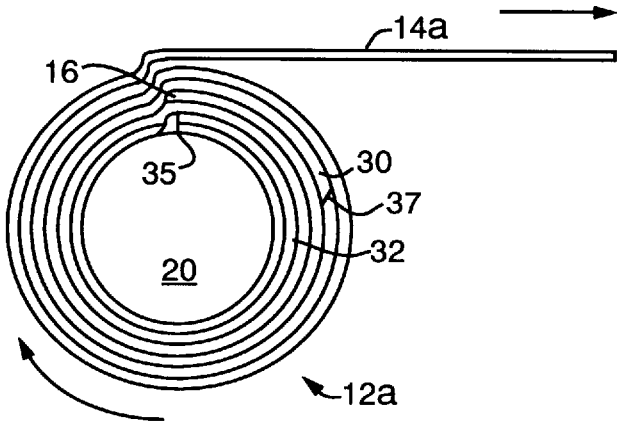
FIGS. 8A–8D are side views of a splice being effected between strips of material having both adherable surfaces according to the roll splicing system and method of the present invention.
Figure 8B:
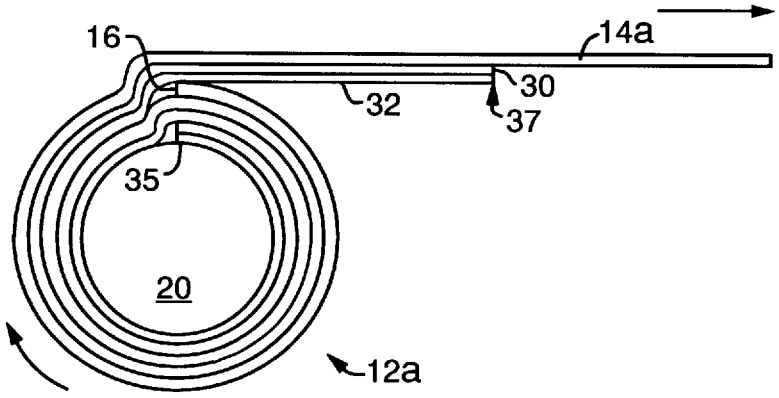

One example of the roll splicing method used with the embodiment shown in FIG. 4 is shown in greater detail in FIGS. 8A–8D. The trailing segment 32, FIG. 8A, is rolled around the core region 20 starting at the first trailing segment end 35. When the expiring strip of material 14*a*, FIG. 8B, of the expiring roll 12*a* is almost entirely unrolled, the second trailing segment end 37 of the trailing segment 32 begins to unwind.

Figure 8C:
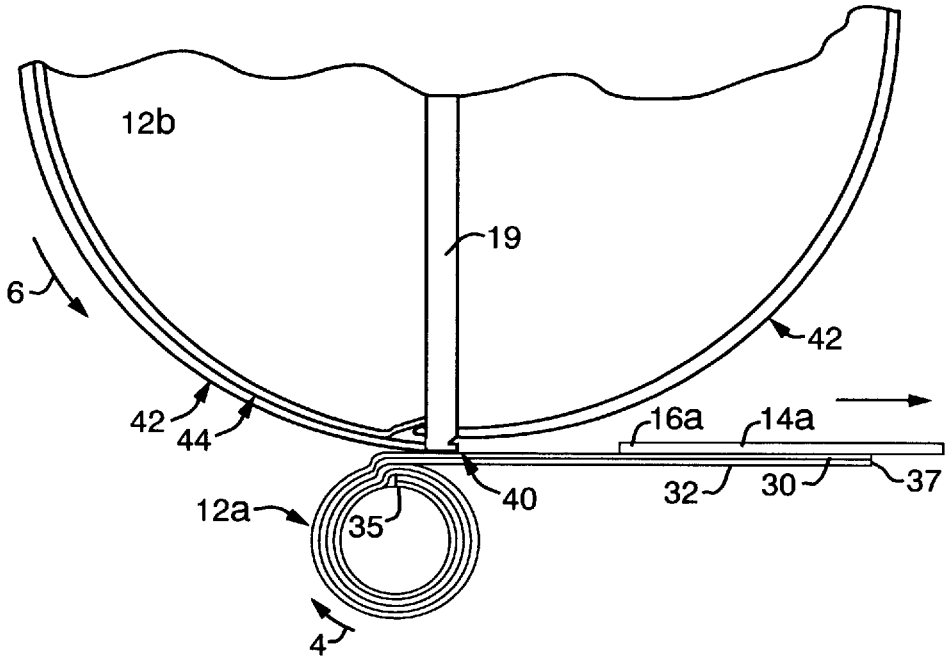

When the entire strip of material 14*a*, FIG. 8C, has been unrolled, the outer adhesive region 30 of the trailing segment 32 is exposed. The expiring roll 12*a* and new roll 12*b* are rotating against one another in opposite directions as indicated by arrows 4, 6. The adhesive region 30 will not adhere to the leading non-adherable region 42 of the new roll 12*b*, but the first adhesive adherable region 40 will adhere to the adhesive region 30 when the first adhesive adherable region 40 rolls against the exposed outer adhesive region 30 of the trailing segment 32. When the first adhesive adherable region 40 adheres to the adhesive region 30, the tape 19 will release and the new roll 12*b* will begin to unwind.

Figure 8D:
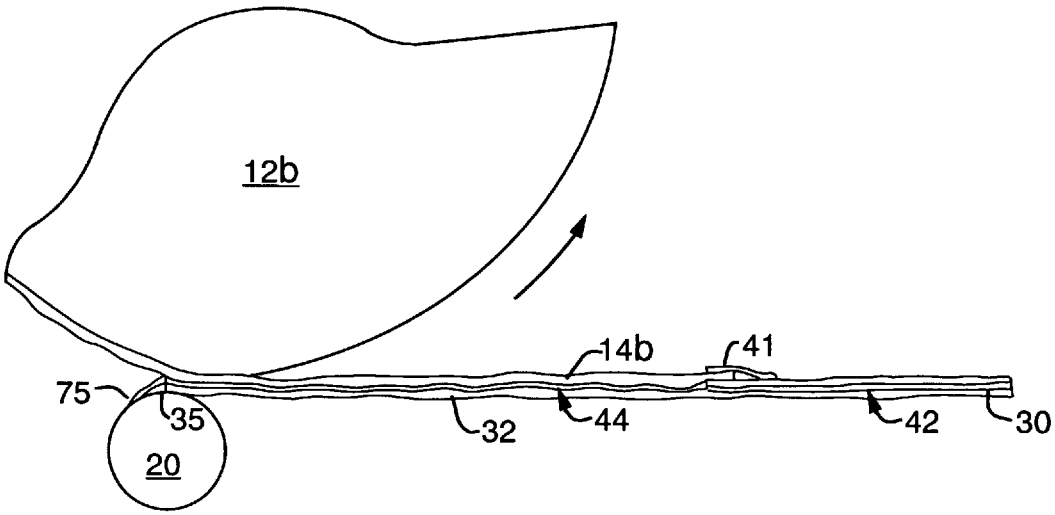

After the leading non-adherable region 42, FIG. 8D, unwinds, the second adhesive adherable region 44 on the new strip of material 14*b* is exposed and will adhere to the adhesive region 30 of the trailing segment 32, preferably for at least one turn of the new roll 12*b*. A secure splice is thereby effected between the strip of material 14*a* of the expiring roll and strip of material 14*b* of the new roll 12*b*. A piece of adhesive tape 21 or other coupling member releasably coupling the first trailing segment end 35 of the trailing segment 32 to the core region 20 will then release from the core region 20, allowing the new roll 12*b* to continue to unroll.

To manufacture the rolls, the trailing and/or leading segments are first coupled to the strip of material. The strip of material together with the trailing and/or leading segments are then rolled around the core region according to conventional roll forming methods known to those skilled in the art.

Accordingly, the present invention provides an efficient and reliable system and method of splicing a new roll to an expiring roll. The roll splicing system and method according to the present invention does not require complex and expensive machinery and also does not require significant operator intervention to oversee the splicing process. The roll splicing system and method according to the present invention can also be used to splice strips of material having a non-adherable surface, such as a silicone coating on one side of the strip of material. The roll splicing system and method according to the present invention also prevents the waste of time and material as a result of slowing the system during splicing and missed splices.

Modifications and substitutions by one of ordinary skill in the art are considered to be within the scope of the present invention which is not to be limited except by the claims which follow.

What is claimed is:

1. A roll splicing system, comprising:

at least one roll including:

a core region;

a strip of material wound around said core region, said strip of material having a trailing end disposed proximate said core region and a leading end disposed proximate an outer roll surface of said roll;

at least a first adhesive adherable region disposed proximate said leading end of said strip of material;

an adhesive region disposed proximate said trailing end of said strip of material and facing generally outward from said core region, for adhering to at least one adhesive adherable region of a leading end of a new roll when said at least one roll expires, thereby splicing said new roll to said at least one roll; and a trailing non-adherable region disposed proximate said trailing end of said strip of material and opposite said adhesive region, wherein said trailing non-adherable region extends beyond said adhesive region such that said adhesive region is contacted by said trailing non-adherable region when rolled around said core region.

2. The roll splicing system of claim 1, further including a leading non-adherable region disposed proximate said leading end of said strip of material, wherein said at least a first adhesive adherable region is disposed at a leading end of said leading non-adherable region, said leading non-adherable region extending substantially around said outer roll surface, for allowing said at least a first adhesive adherable region to initially adhere to an adhesive region of an expiring roll.

3. The roll splicing system of claim 2, further including a second adhesive adherable region disposed at a trailing end of said leading non-adherable region, for secondarily adhering to said adhesive region of said expiring roll.

4. The roll splicing system of claim 3, wherein said first adhesive adherable region, said leading non-adherable region, and said second adhesive adherable region are disposed on an outer surface of said strip of material proximate said leading end of said strip of material.

5. The roll splicing system of claim 2, further including a leading non-adherable segment coupled proximate said leading end of said strip of material, said leading non-adherable segment having said leading non-adherable region.

6. The roll splicing system of claim 1, wherein said adhesive region is disposed on an outer surface of said strip of material proximate said trailing end of said strip of material, and wherein said trailing non-adherable region is disposed on an inner surface of said strip of material proximate said trailing end of said strip of material.

7. The roll splicing system of claim 1 wherein said trailing non-adherable region includes a silicone coating.

8. The roll splicing system of claim 1 wherein said adhesive region has a length of at least one turn of said new roll, for adhering to an adhesive adherable region proximate a leading end of said new roll.

9. The roll splicing system of claim 1 wherein said strip of material includes outer and inner surfaces of an adhering material.

10. The roll splicing system of claim 1 wherein said strip of material includes at least one of an inner surface and an outer surface of a non-adhering material.

11. The roll splicing system of claim 10 wherein said non-adhering material includes silicone.

12. The roll splicing system of claim 1 wherein said at least one roll includes first and second rolls, said strip of material of said first roll having an outer non-adhering surface, and said strip of material of said second roll having an inner non-adhering surface, wherein said first roll splices with said second roll such that said outer non-adhering surface of said first roll is facing in the same direction as said inner non-adhering surface of said second roll.

13. The roll splicing system of claim 1, further including first and second spindles, and wherein said at least one roll includes a first roll disposed on said first spindle and a second roll disposed on said second spindle.

14. The roll splicing system of claim 13 wherein said first spindle is fixed and said second spindle is pivotable.

15. The roll splicing system of claim 13 wherein one of said first and second rolls is an expiring roll rotating in a first direction, and wherein the other of said first and second rolls is a new roll rotating in a second direction opposite said first direction, for splicing with said expiring roll at said adhesive region at said trailing end of an expiring strip of material of said expiring roll.

16. A method of splicing an expiring roll to a new roll, said method comprising:

unrolling an expiring strip of material from said expiring roll by rotating said expiring roll in a first direction;

rotating said new roll proximate said expiring roll in a second direction opposite said first direction;

contacting at least one adhesive adherable region proximate a leading end of said new strip of material with an adhesive region proximate a trailing end of said expiring strip of material from said expiring roll, wherein said at least one adhesive adherable region of said new strip of material from said new roll is adhered to said adhesive region; and unrolling said new roll.

17. The method of claim 16 wherein said expiring roll and said new roll are rotatably mounted on first and second spindles.

18. The method of claim 17 wherein said first spindle is a fixed spindle and said second spindle is a pivoting spindle.

19. The method of claim 17 further including:

removing said expiring roll from said first spindle when said expiring roll has expired; and rotatably mounting a new roll on said first spindle.

20. The method of claim 17 wherein said expiring strip of material and said new strip of material each have a first non-adhering surface and a second adhering surface, and wherein a portion of said new strip of material is contacted with said adhesive region coupled to said trailing end of said expiring strip of material such that said first non-adhering surfaces and said second adhering surfaces of said expiring strip of material and said new strip of material are oriented in the same direction.

21. A roll for use in a roll spicing system, said roll comprising:

a core region;

a strip of material wound around said core region, said strip of material having a trailing end disposed proximate said core region and a leading end disposed proximate an outer roll surface of said roll;

a trailing segment having a first trailing segment end releasably coupled to said core region and a second trailing segment end coupled to said trailing end of said strip of material, said trailing segment including an adhesive region disposed on an outer surface of said trailing segment and a trailing non-adherable region disposed on an inner surface of said trailing segment, wherein said trailing non-adherable region contacts said adhesive region when said trailing segment is wound around said core region, and wherein an inner adherable surface of said strip of material does not contact said adhesive region of said trailing segment when said strip of material is wound around said core region.

22. The roll splicing system of claim 21 wherein a portion of said strip of material is adhered to a first portion of said adhesive region of said trailing segment.

23. The roll splicing system of claim 22 wherein said adhesive region includes a second portion having a length of at least one turn of a new roll, for adhering to an adhesive adherable region of said new roll proximate a leading end of said new roll.

24. A roll of claim 21, further including;

a leading non-adherable segment coupled proximate said leading end of said strip of material; and a leading adhesive adherable segment coupled to a leading end of said leading non-adherable segment, wherein said leading non-adherable segment extends substantially around said outer roll surface such that said leading adhesive adherable segment initially adheres to said an adhesive region of an expiring roll.

25. The roll splicing system of claim 24, further including at least one coupling member, for releasably coupling said leading non-adherable segment against said outer roll surface.

26. The roll splicing system of claim 25 wherein said at least one coupling member includes said at least one adhesive adherable region.

27. A roll splicing system comprising:

at least first and second types of rolls, wherein each of said first and second types of rolls includes a core region and a strip of material having a trailing end disposed proximate said core region and a leading end disposed proximate an outer surface of said roll when said strip of material is wound around said core region, said strip of material of said first type of roll having an outer non-adhering surface and an inner adherable surface, said strip of material of said second type of roll having an inner non-adhering surface and an outer adherable surface, wherein said first type of roll splices with said second type of roll such that said outer non-adhering surface of said first type of roll is facing the same direction as said inner non-adhering surface of said second type of roll;

each of said first and second types of rolls further including a trailing segment having a first trailing segment end releasably coupled to said core region and a second trailing segment end coupled to said trailing end of said strip of material, said trailing segment having an adhesive region disposed on an outer surface of said trailing segment and a non-adherable region disposed on an inner surface of said trailing segment, wherein said non-adherable region contacts said adhesive region when said trailing segment is wound around said core region;

said first type of roll further including at least one leading segment coupled proximate said leading end of said strip of material, said leading segment having a first outer adhesive adherable region at a leading end of said leading segment, an outer non-adherable region extending from said first outer adhesive adherable region substantially around said outer roll surface, and a second outer adhesive adherable region extending from said outer non-adherable region, wherein said first outer adherable region of said first type of roll initially adheres to said adhesive region on said trailing segment of said second type of roll; and said second type of roll including at least one leading segment coupled proximate said leading end of said strip of material, said leading non-adherable segment having an adhesive adherable region at a leading end thereof and an outer non-adherable region extending from said adhesive adherable region substantially around said outer roll surface, wherein said first outer adherable region of said second type of roll initially adheres to said adhesive region on said trailing segment of said first type of roll.

* * * * *